US007739871B2

(12) United States Patent
Cotter et al.

(10) Patent No.: US 7,739,871 B2
(45) Date of Patent: Jun. 22, 2010

(54) PRESS-DRIVEN TOOL ACTUATION SYSTEM

(75) Inventors: Jonathan P. Cotter, Dearborn, MI (US); Jeremy M. Kluck, Howell, MI (US); Jason L. Vandine, Redford, MI (US)

(73) Assignee: DADCO, Inc., Plymouth, MI (US)

( * ) Notice: Subject to any disclaimer, the term of this patent is extended or adjusted under 35 U.S.C. 154(b) by 368 days.

(21) Appl. No.: 11/771,202

(22) Filed: Jun. 29, 2007

(65) Prior Publication Data

US 2009/0000295 A1 Jan. 1, 2009

(51) Int. Cl.
*F15B 7/08* (2006.01)

(52) U.S. Cl. ..... 60/563; 60/574; 60/581

(58) Field of Classification Search ..... 60/563, 60/566, 567, 574, 581, 591
See application file for complete search history.

(56) References Cited

U.S. PATENT DOCUMENTS 3,089,375 A * 5/1963 Williamson ..... 60/430
3,407,601 A * 10/1968 Beck ..... 60/563
3,688,501 A * 9/1972 Ellis ..... 60/589
3,875,365 A * 4/1975 Beneteau ..... 60/560
5,125,234 A * 6/1992 Yonezawa et al. ..... 60/563
5,927,178 A 7/1999 Stenquist
5,943,862 A * 8/1999 Malina ..... 60/563
6,295,813 B1 10/2001 Stenquist

* cited by examiner

*Primary Examiner*—F. Daniel Lopez
(74) *Attorney, Agent, or Firm*—Reising Ethington P.C.

(57) ABSTRACT

A hydraulically-operated press-driven tool actuation system includes a press-driven hydraulic power device and/or a hydraulically-powered tool actuator. In the tool actuator, at least two pistons are carried by a housing, and at least one return device is carried by the housing laterally inboard of the pistons. In the power device, a pump includes a piston disposed in a pump cylinder for pressurizing hydraulic fluid therein. An accumulator is in fluid communication with the pump cylinder, and includes a piston disposed in an accumulator cylinder that houses hydraulic fluid on one side of the piston. A body supports the pump and accumulator thereon and is in fluid communication between the pump and accumulator cylinders. The body includes a pressure relief valve downstream of the pump cylinder and upstream of the accumulator cylinder, and a check valve downstream of the accumulator cylinder and upstream of the pump cylinder.

16 Claims, 9 Drawing Sheets

300
372
376
374
376
374
314
370
361
360
322
358
356
355
356
322
358
366
362
354
354
364
366
364
361
310
348
350
352
321
318b
348
307
305
316
351
21
342
312
332
342
313
336
332
304
342
308
305
316
309
318a
348
321
349
352
350
320
320
302

PRESS-DRIVEN TOOL ACTUATION SYSTEM

FIELD OF THE INVENTION

The present invention relates generally to tool actuation systems and, more particularly, press-driven tool actuation systems.

BACKGROUND OF THE INVENTION

In manufacturing parts from sheet metal, a metal forming press forms a flat sheet of metal positioned between upper and lower platens. The upper platen carries an upper die and is closed toward a lower die carried by the lower platen wherein certain portions of the sheet are cut, bent, drawn, or pierced by different features of the dies. Sometimes, separate press-mounted devices form other portions of the sheet along a direction different from the closing direction of the press. Accordingly, press-driven tool actuators convert press closing motion into transverse tool motion, and typically include mechanically or hydraulically actuated "cams."

Mechanically actuated cams include an adapter body mounted to the upper platen or a die, a slider mounted on the adapter body to drive a tool affixed thereto, and a driver mounted on the lower platen or die. When the slider engages the driver, the press closing motion creates a camming action to drive the slider in a direction transverse to the press closing motion. But such devices are bulky, and require highly precise component alignment.

Hydraulically actuated "cams" include a tool actuator mounted on the lower platen for carrying and actuating a tool, and a pump mounted on the lower platen for converting mechanical power from the closing upper platen into fluid power for delivery to the tool actuator. The tool actuator includes a housing fastened to the lower platen, and a hydraulic cylinder and piston carried centrally by the housing for advancing an actuator plate. Separate guide rods are slidably carried through the housing outboard of the hydraulic piston and are attached at one end to the actuator plate and at another end to a return plate. Likewise, gas springs are carried by the housing outboard of the hydraulic piston and impose a force on the return plate for retracting the actuator plate via the guide rods. Although such devices are simpler and more flexible than the mechanical cams, they can be too bulky for certain small space applications.

SUMMARY OF THE INVENTION

A hydraulically-operated press-driven tool actuation system includes one or both of a press-driven hydraulic power device or a hydraulically-powered tool actuator, which may be powered by the hydraulic power device. In the tool actuator, at least two pistons are carried by a housing, and at least one return device is carried by the housing laterally inboard the at least two pistons. In the power device, a pump includes a piston disposed in a pump cylinder for pressurizing hydraulic fluid therein. An accumulator is in fluid communication with the pump cylinder, and includes a piston disposed in an accumulator cylinder that houses hydraulic fluid on one side of the piston. A body supports the pump and accumulator thereon and is in fluid communication between the pump and accumulator cylinders. The body includes a pressure relief valve downstream of the pump cylinder and upstream of the accumulator cylinder, and includes a check valve downstream of the accumulator cylinder and upstream of the pump cylinder.

At least some of the objects, features and advantages that may be achieved by at least certain embodiments of the invention include providing a hydraulically-operated press-driven tool actuation system that provides a relatively low profile and compact length of a hydraulically-driven tool actuator; may be used in any orientation on a press; provides high tooling forces per unit area of die used; enables a relatively high stripping force; offers high resistance to side thrust and torsional tooling forces; is operable under relatively high fluid pressure; allows for visual oil level monitoring; does not require a nitrogen gas accumulator or nitrogen gas pump rod return; and is of relatively simple design, economical manufacture and assembly, rugged, durable, reliable, and in service has a long useful life.

Of course, other objects, features and advantages will be apparent in view of this disclosure to those skilled in the art. Various other devices embodying the invention may achieve more or less than the noted objects, features or advantages.

BRIEF DESCRIPTION OF THE DRAWINGS

These and other objects, features and advantages of the present invention will be apparent from the following detailed description of preferred embodiments and best mode, appended claims, and accompanying drawings in which:

DETAILED DESCRIPTION OF PREFERRED EMBODIMENTS

Figure 1:
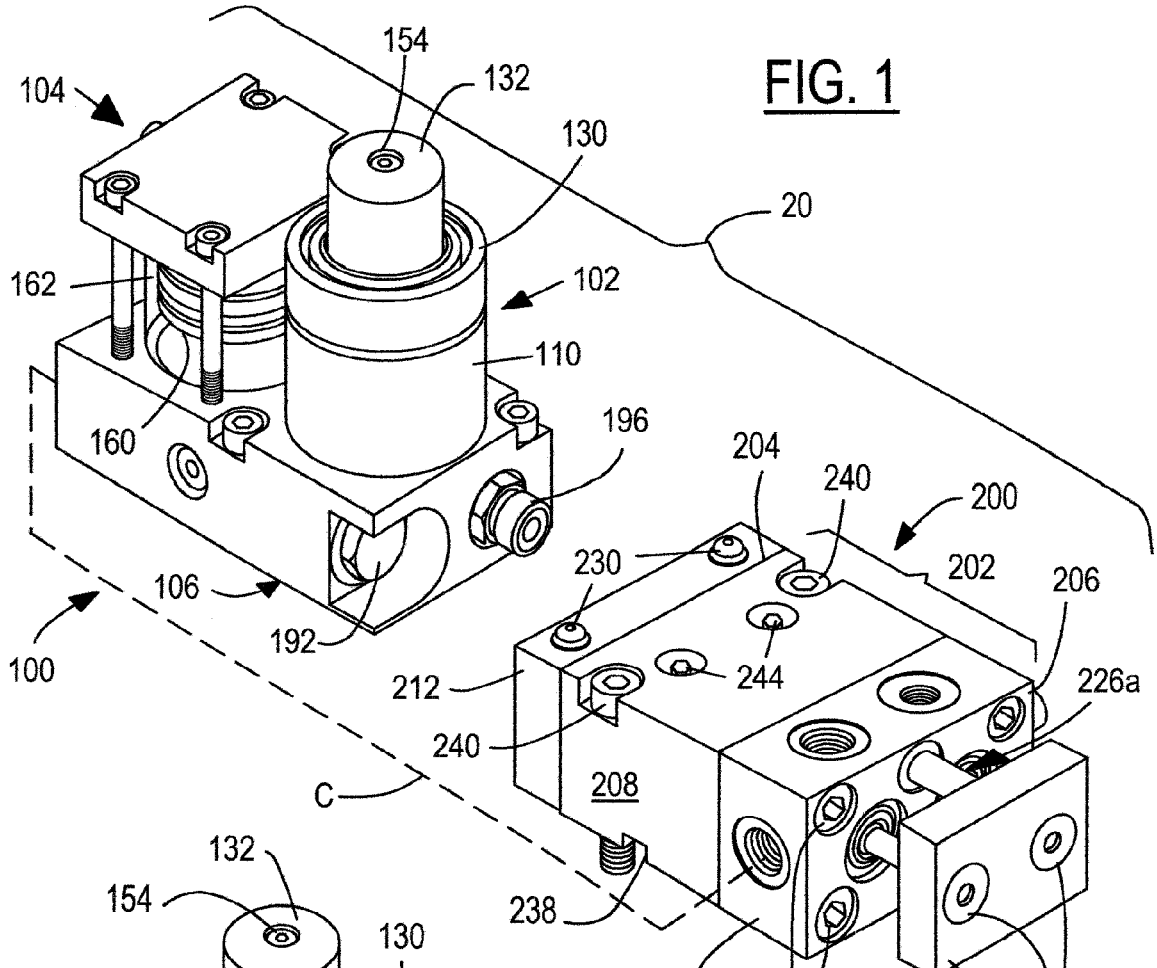
FIG. 1 is a perspective view of one presently preferred form of a hydraulically-operated press-driven tool actuation system, including a tool actuator hydraulically-powered by a press-driven hydraulic power device.

Referring in more detail to the drawings, FIG. 1 illustrates a hydraulically-operated press-driven tool actuation system 20 for actuating one or more press tools (not shown). The press tools could include any suitable forming tools such as punches, shears, drawing or bending tools, or the like. The system 20 is preferably adapted for use in a sheet metal forming press (not shown), which may include a bed carrying a lower platen and a ram carrying an upper platen, and upper and lower dies carried respectively by the upper and lower platens. A sheet metal blank (not shown) can be placed between the platens, wherein the upper die advances along a closing direction toward the lower die to form various features in the sheet metal blank.

In general, the system 20 includes a tool actuator 200 for actuating a press tool to form features on the sheet metal blank, a press-driven hydraulic power device 100 for converting mechanical motion from the press into hydraulic fluid pressure to power the tool actuator 200, and any suitable hydraulic conduit C therebetween. Preferably, the tool actuator 200 is used with the hydraulic power device 100, and vice-versa. However, it is contemplated that either the tool actuator 200 or the hydraulic power device 100 could be used with other devices. For example, other exemplary devices are disclosed in U.S. Pat. No. 6,295,813, which is assigned to the assignee hereof and is incorporated herein by reference in its entirety.

The hydraulic power device 100 can be any suitable device for generating hydraulic fluid pressure for delivery to one or more tool actuators. Preferably, however, the hydraulic power device 100 is mechanically driven by a downward force imposed by the ram of the press via the upper die or platen so as to produce hydraulic fluid pressure. The hydraulic power device 100 may be carried by the press bed in any suitable manner such as via mounting to the lower platen or die(s).

Figure 2:
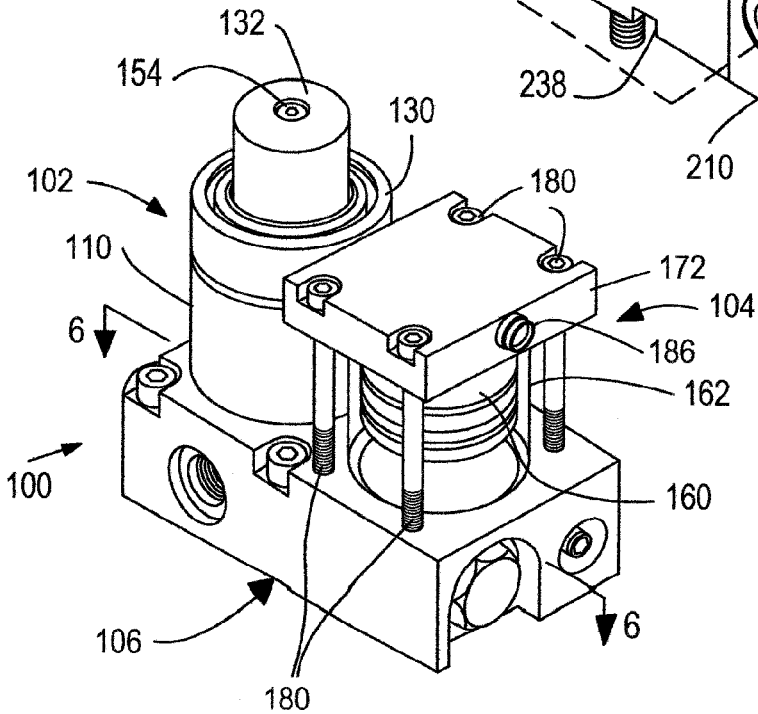
FIG. 2 is another perspective view of the hydraulic power device of FIG. 1.
Figure 3:
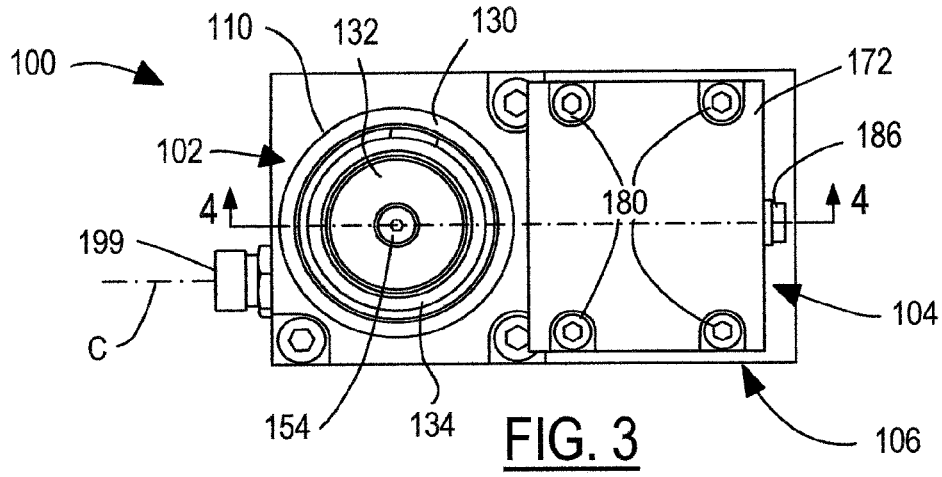
FIG. 3 is a top view of the hydraulic power device of FIG. 1.

Referring to FIGS. 1 through 3, the hydraulic power device 100 includes a hydraulic pump 102 for pressurizing hydraulic fluid, and a hydraulic accumulator 104 in fluid communication with the hydraulic pump 102 for protecting the system 20 from overpressure conditions. The hydraulic power device 100 may also include a body 106 that carries the pump 102 and accumulator 104 thereon and that is in fluid communication with the pump 102 and the accumulator 104. Preferably, the pump 102 and accumulator 104 are carried side-by-side on the body 106. The body 106 can be comprised of a single body or multiple bodies, or the like.

Figure 4:
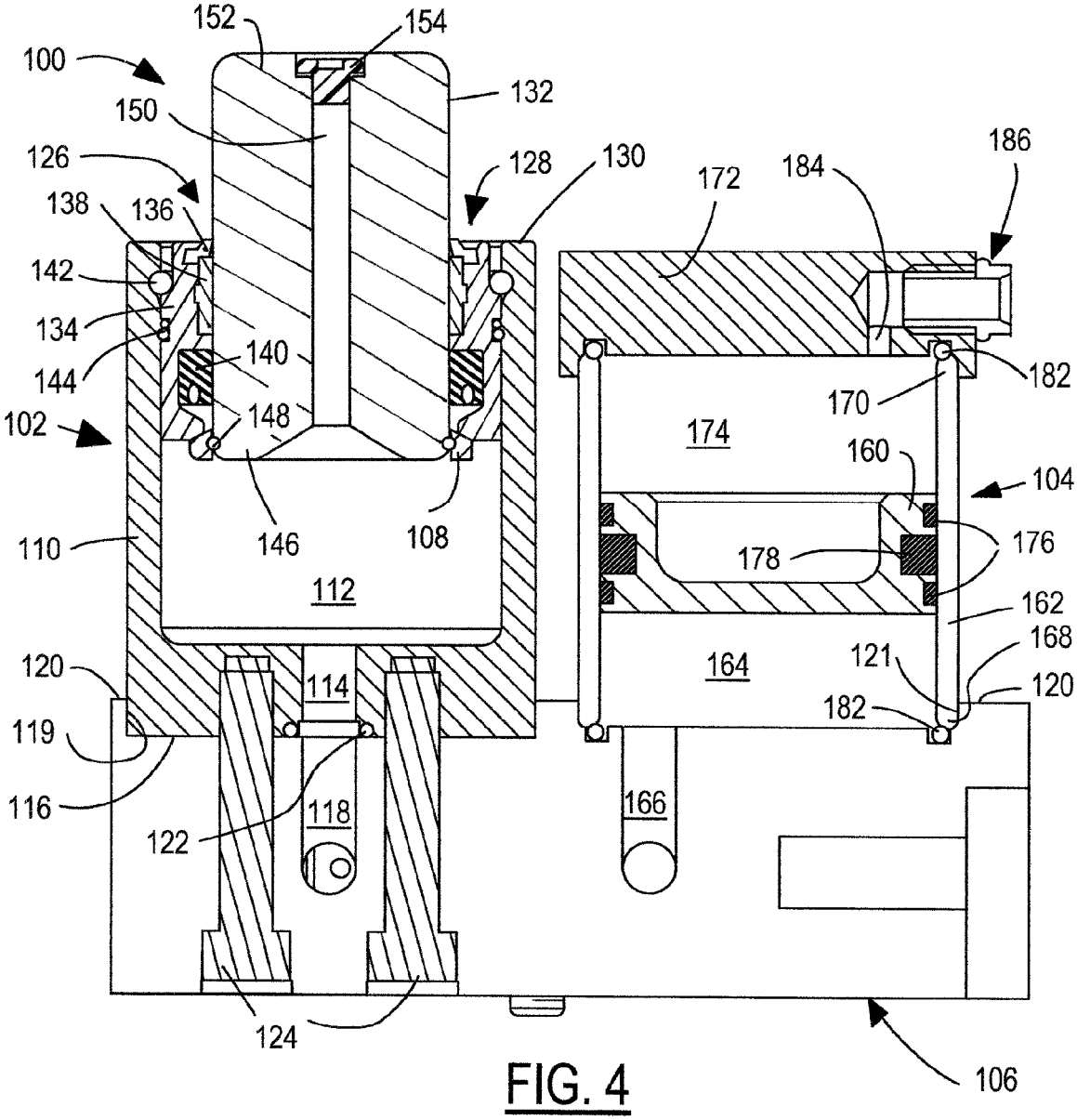
FIG. 4 is an enlarged cross-sectional view of the hydraulic power device taken along line 4-4 of FIG. 3.

Referring to FIG. 4, the hydraulic pump 102 includes a piston rod 132 and retainer 108 movable in a cylinder 110 to pressurize hydraulic fluid in the cylinder 110. The piston rod 132 and retainer 108, and the cylinder 110 define a pressure chamber 112 in communication with a pump outlet passage 114 in an otherwise closed end 116 of the cylinder 110. The pump outlet passage 114 is in fluid communication with a body inlet passage 118 in the body 106. The cylinder 110 is mounted to a first surface 120 of the body 106 wherein the closed end 116 of the cylinder 110 is fit within a recess 119 in the first surface 120 of the body 106 with a seal 122 therebetween to seal the passages 114, 118. The cylinder 110 may be fastened to the body 106 with any suitable fasteners 124 such as cap screws. The piston rod 132 is actuated by the press ram via a plunger assembly 126 including a bearing and seal assembly 128 carried in an open end 130 of the cylinder 110, and the piston rod 132 carried in the bearing and seal assembly 128.

The bearing and seal assembly 128 includes a bearing and seal housing 134 of relatively thin wall cross section to enable maximization of the rod diameter. The bearing and seal housing 134 carries a rod wiper 136, bearing 138, and seal 140 at an inner diameter thereof. The bearing and seal housing 134 is retained within the cylinder 110 by any suitable retainer such as a wire retention ring 142 and is sealed thereto with one or more seals 144. The piston rod 132 is attached at a forward end 146 thereof to the piston retainer 108 with any suitable retainer such as a wire retention ring 148. The piston rod 132 includes an air bleed passage 150 extending through the piston rod 132 from the forward end 146 to a rearward end 152, and an air bleed valve 154 is preferably sealingly threaded into the passage 150. The aforementioned plunger assembly construction enables the piston rod 132 to be manufactured from any suitable pre-ground shaft material.

The accumulator 104 may be an air-over-oil type of device, which includes a piston 160 disposed in a cylinder 162 for housing a gas, such as air, on one side of the piston 160 and a portion of the hydraulic fluid on the other side of the piston 160. Accordingly, the piston 160, cylinder 162, and body 106 substantially define an accumulation chamber 164 in communication with an accumulator passage 166 in the body 106 at one open end 168 of the cylinder 162. At another open end 170 of the cylinder 162, the cylinder 162, piston 160, and an accumulator cover 172 substantially define a gas chamber 174. The gas chamber 174 may instead, or additionally, include a spring (not shown) to bias the piston 160.

In one embodiment, the cylinder 162 is preferably a tube composed of any suitable translucent or transparent material, such as glass or LEXAN or the like, as a simple means of visibly verifying proper oil level. In another embodiment, the cylinder 162 may be composed of a non-ferrous opaque material such as fiberglass, aluminum, or the like, wherein the piston 160 may be composed of a ferrous material for use in conjunction with a magnetic oil level indicator (not shown). These embodiments may enable easy monitoring of oil level so that make up oil can be added upon visual inspection.

In either case, the piston 160 may include guide rings 176 to prevent wear and any suitable sealing ring(s) 178 to sealingly isolate the chambers 164, 174 from one another. The cylinder 162 is mounted to the first surface 120 of the body 106 wherein the one open end 168 of the cylinder 162 is fit within a recess 121 in the first surface 120 of the body 106 with a seal 182 therebetween. Any suitable sealing ring(s) 182 may be interposed between the cylinder 162 and the body 106 and cover 172 to seal the accumulator 104.

The cover 172 closes off the gas chamber 174 and provides a means to help fasten the accumulator 104 to the body 106 wherein any suitable fasteners 180 (FIG. 2) may be inserted through the cover 172 and fastened to the body 106. The cover 172 may include a gas exhaust passage 184 in fluid communication between the gas chamber 174 and the atmosphere. The exhaust passage 184 may also include a suitable pressure fitting 186, such as a check valve or the like to permit gas to escape from the gas chamber 174.

Figure 5:
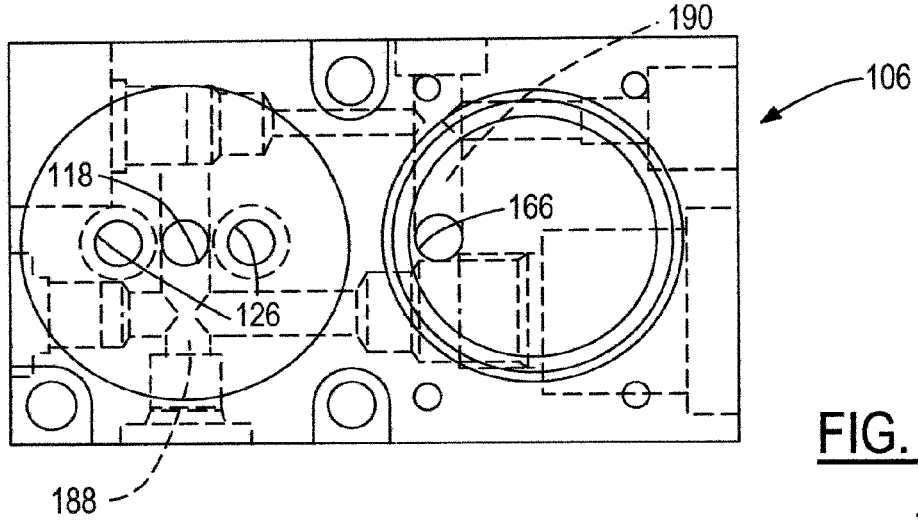
FIG. 5 is a top view of a body of the hydraulic power device of FIG. 1.
Figure 6:
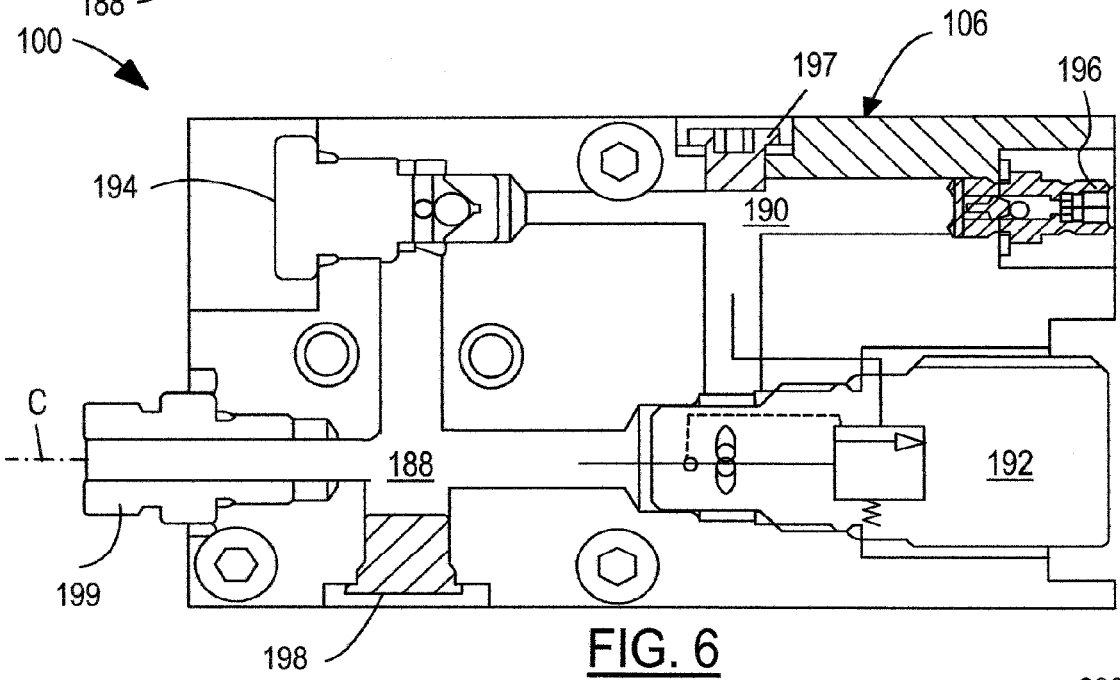
FIG. 6 is a cross-sectional view of a portion of the hydraulic power device of FIG. 2, taken along line 6-6 thereof.

The body 106 of the hydraulic power device 100 includes passages in fluid communication with the respective chambers 112, 164 of the hydraulic pump 102 and accumulator 104. Again, and as shown in FIGS. 5 and 6, the body 106 may include the body inlet passage 118 and accumulator passage 166, and may also include high pressure passages 188 and low pressure passages 190. As shown in FIG. 6, the body 106 may also carry a pressure relief valve 192 between the high and low pressure passages 188, 190 downstream of the pressure chamber 112 and upstream of the accumulator chamber 164. Similarly, the body 106 may further carry a check valve 194 between the high and low pressure passages 188, 190 downstream of the accumulator chamber 164 and upstream of the pressure chamber 112. The body 106 may additionally carry an oil fill fitting 196 and drain plug 197 in communication with the low pressure passages 190. Referring also to FIG. 4, make up oil may be introduced into the system 20 through the oil fill fitting 196, and the air bleed valve 154 may be opened to bleed air from the system through the air bleed passage 150 in the piston rod 132. The body 106 may also include any suitable plugs 198, or outlet fittings 199 in communication with the high pressure passages 188 for connecting to any suitable conduit for communication with one or more tool actuators.

Referring now to FIGS. 1, and 7 through 14, the tool actuator 200 can be any suitable device for converting hydraulic fluid pressure into mechanical motion to actuate one or more press tools T. For example, the tool actuator 200 may be driven by fluid pressure delivered from the hydraulic power device 100 of FIGS. 1 through 6. The tool actuator 200 may be carried by the press bed such as by mounting to the lower platen or die(s). The tool actuator configuration described below may enable highly rigid tool mounting and a low profile envelope that is well suited for stamping die tooling.

Figure 10:
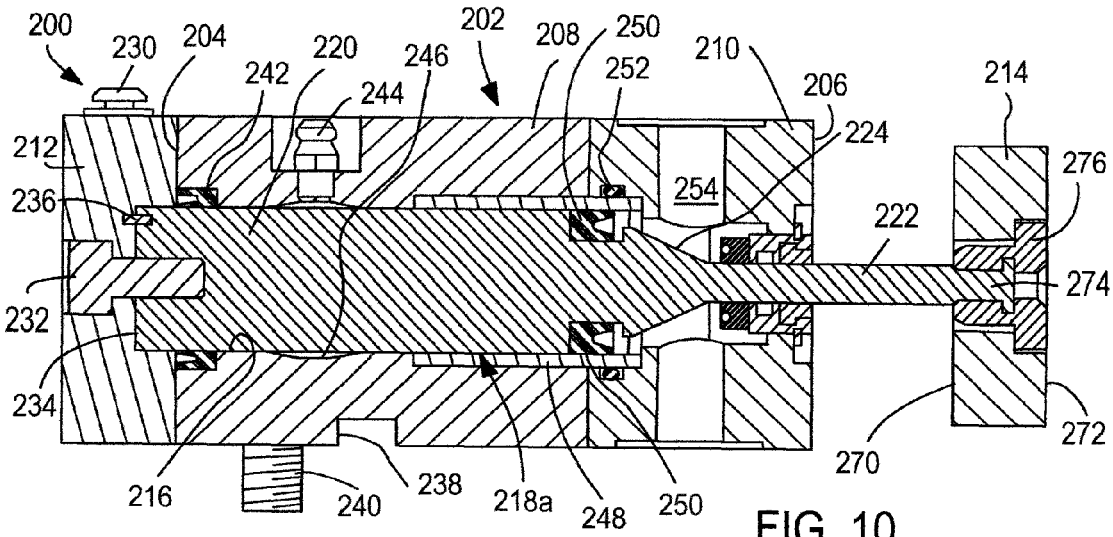
FIG. 10 is a cross-sectional view of the tool actuator of FIG. 7, taken along line 10-10 thereof, and shown in its unactuated position.

The tool actuator 200 includes a housing 202, which can be comprised of a single body or multiple bodies, or the like. In any case, the housing 202 has a front end 204 and a rear end 206 and may be defined by a piston block 208 and a manifold bearing block 210. The tool actuator 200 also includes an actuation plate 212 disposed at the front end 204 of the housing 202, and a return plate 214 disposed at the rear end 206 of the housing 202. As best shown in FIG. 10, the tool actuator 200 further includes a pair of cylinders 216 (one shown) extending longitudinally through the housing 202, and a pair of pistons 218*a*, 218*b* (one shown) disposed in the pair of cylinders 216 and connected to the actuation and return plates 212, 214 for use in advancing and retracting the actuation plate 212.

Figure 14:
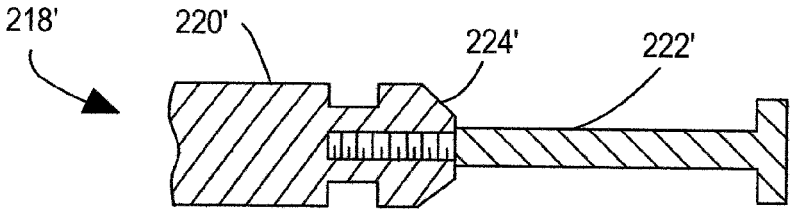
FIG. 14 is a side view of a portion of a two-piece piston and guide rod according to an alternative actuator piston design.

The pistons 218*a*, 218*b* are preferably defined by forward piston portions 220, rearward guide rod portions 222, and reaction surfaces 224 therebetween. The reaction surfaces 224 are preferably tapered or conical, as shown. The pistons 218*a*, 218*b* are preferably unitary components but, as shown in FIG. 14, pistons 218' could instead be two-piece assemblies including rearward guide rod portions 222' threaded into forward piston portions 220', which have reaction surfaces 224'. In any case, the guide rod and piston portions 220, 220', 222, 222' are preferably coaxial as shown.

Figure 12:
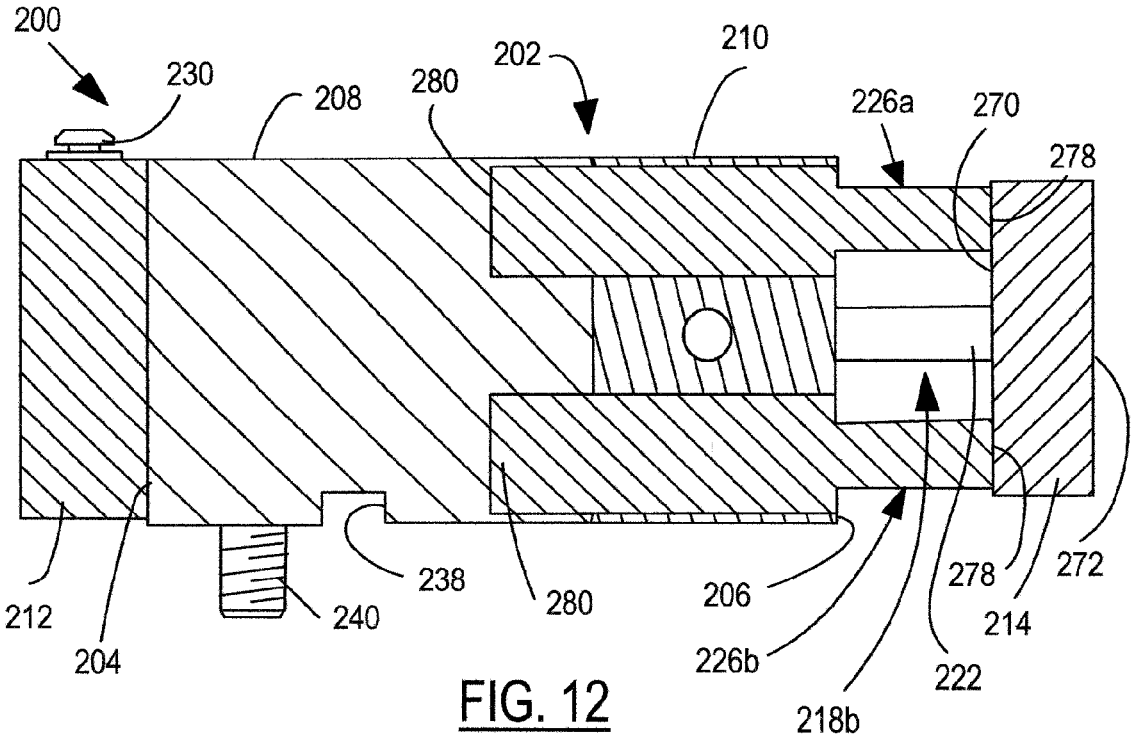
FIG. 12 is a cross-sectional view of the tool actuator of FIG. 7, taken along line 12-12 thereof to illustrate a pair of gas springs.

Referring to FIGS. 1 and 12, the tool actuator 200 further includes one or more return devices, such as springs and, more particularly, gas springs 226*a*, 226*b*. Although two gas springs 226*a*, 226*b* are shown, any suitable quantity and type(s) of return device(s) may be used. The gas springs 226*a*, 226*b* are carried by the housing 202 laterally inboard of the pistons 218*a*, and 218*b* and are operatively biased against the return plate 214 to retract the actuation plate 212 via the pistons 218*a*, 218*b*.

Figure 13:
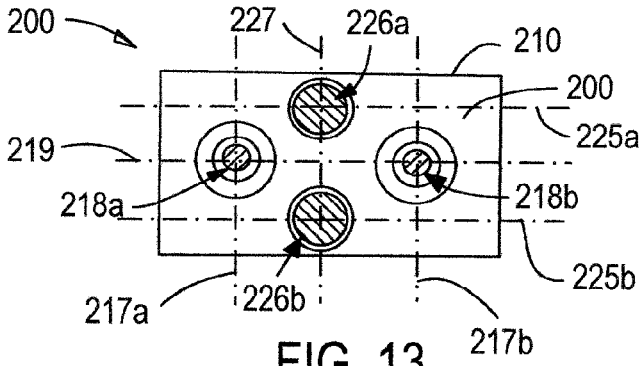
FIG. 13 is a cross-sectional view of the tool actuator taken along line 13-13 of FIG. 7.

FIG. 13 illustrates an exemplary arrangement of the gas springs 226*a*, 226*b* and the pistons 218*a*, 218*b*. As shown, the pistons 218*a*, 218*b* share a common horizontal centerline 219 and the gas springs 226*a*, 226*b* share a common vertical centerline 227. According to other embodiments, the pistons 218*a*, 218*b* may each have their own horizontal centerline, and/or the gas springs 226*a*, 226*b* may each have their own vertical centerline. The centerlines or centerline 227 of the springs 226*a*, 226*b* is/are preferably laterally or horizontally disposed between vertical centerlines 217*a*, 217*b* of the pistons 218*a*, 218*b*. Likewise, the centerlines or centerline 219 of the pistons 218*a*, 218*b* is/are preferably disposed vertically inboard of horizontal centerlines 225*a*, 225*b* of the springs 226*a*, 226*b*, such that the spring centerlines 225*a*, 225 are disposed vertically outboard of the piston centerline 219. Directional words such as front, rear, top, bottom, upper, lower, radial, circumferential, axial, lateral, longitudinal, vertical, horizontal, transverse, and the like are employed by way of description and not limitation.

Thus, unlike prior devices that use guide rods and gas springs disposed laterally and/or vertically outboard of a single piston, the tool actuator 200 does not use guide rods and/or gas springs disposed laterally and/or vertically outboard of the pistons 218*a*, 218*b*. Rather, the tool actuator 200 uses return devices disposed laterally inboard of the pistons 218*a*, 218*b*. Although the return devices 226*a*, 226*b* are shown disposed vertically outboard of the pistons 218*a*, 218*b*, other embodiments could include one or more return devices disposed vertically between the pistons 218*a*, 218*b*, vertically aligned with the pistons 218*a*, 218*b*, or the like.

Figure 7:
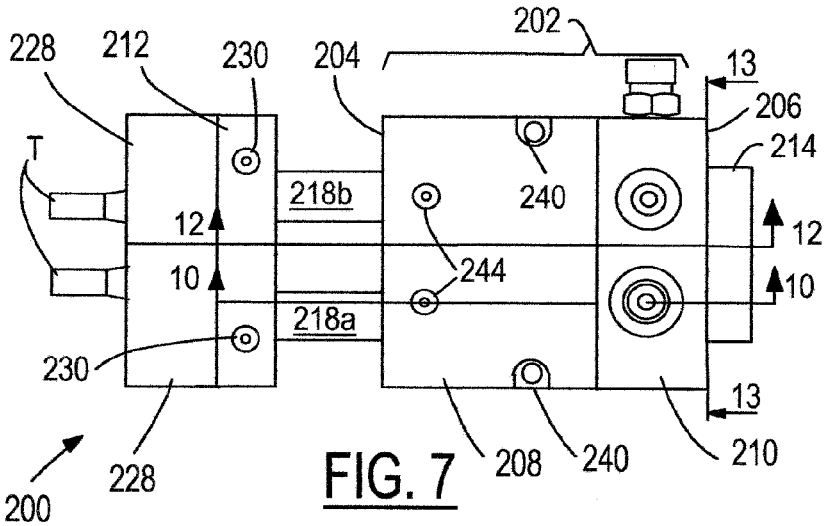
FIG. 7 is a top view of the tool actuator of FIG. 1, shown in a fully actuated position.
Figure 8:
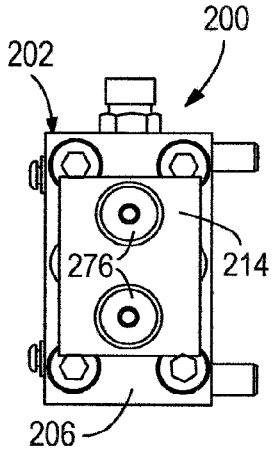
FIG. 8 is a rear view of the tool actuator of FIG. 1, shown in a fully actuated position.
Figure 9:
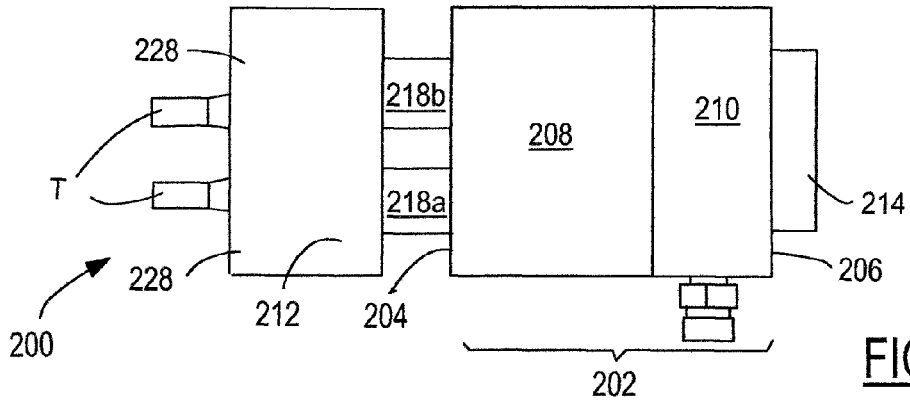
FIG. 9 is a bottom view of the tool actuator of FIG. 1, shown in a fully actuated position.

The actuation plate 212 may be adapted to a wide range of press tooling. For example, as shown in FIGS. 7 and 9, the actuation plate 212 can be adapted for use with one or more punches T, which can be carried by and fastened to the actuation plate 212 in any suitable manner, such as using retainer blocks 228 and fasteners (not shown). The actuation plate 212 can also or instead be adapted to carry bending, shearing, drawing, or other types of tooling. The actuation plate 212 may also include any suitable fasteners 230 in a top surface thereof to hold a shroud (not shown) for protecting the tool actuator 200 from contamination.

Referring now to FIG. 10, the actuation plate 212 is connected to the pistons 218*a*, 218*b* in any suitable manner, such as by a separate fastener like a cap screw 232 threaded into forward ends 234 of the pistons 218*a*, 218*b*. Also, the forward ends 234 of the pistons 218*a*, 218*b* are preferably doweled to the actuation plate 212 with dowel pins 236 or other suitable doweling feature(s) to prevent rotation of the pistons 218*a*, 218*b*. Accordingly, any thrust and torque reaction forces from the tooling T are transmitted to the pistons 218*a*, 218*b*.

The piston block 208 of the housing 202 carries the forward piston portions 220 of the pistons 218*a*, 218*b*. The piston block 208 is preferably a bearingless block of any suitable material such as an ion-nitride coated and tempered SAE 4140 steel, cast iron, or the like. The piston block 208 can be located and fastened to any suitable press component using suitable keyways 238 and fasteners 240 carried by the piston block 208. The piston block 208 may include a counterbore in a forward end for carrying any suitable wiper or seal 242, and a grease fitting 244 in communication with a grease cavity 246. The piston block 208 may also include counterbore in a rearward end for carrying any suitable sealing tube 248 therein for sealing the guide piston 218*a*, 218*b* to the piston block 208 via a piston seal 250, which may be a skirt seal or U-cup seal or the like. The separate sealing tube 248 may be provided as a sealing diameter and not as a guide diameter so as to minimize wear and contamination on the piston seal 250.

Figure 11:
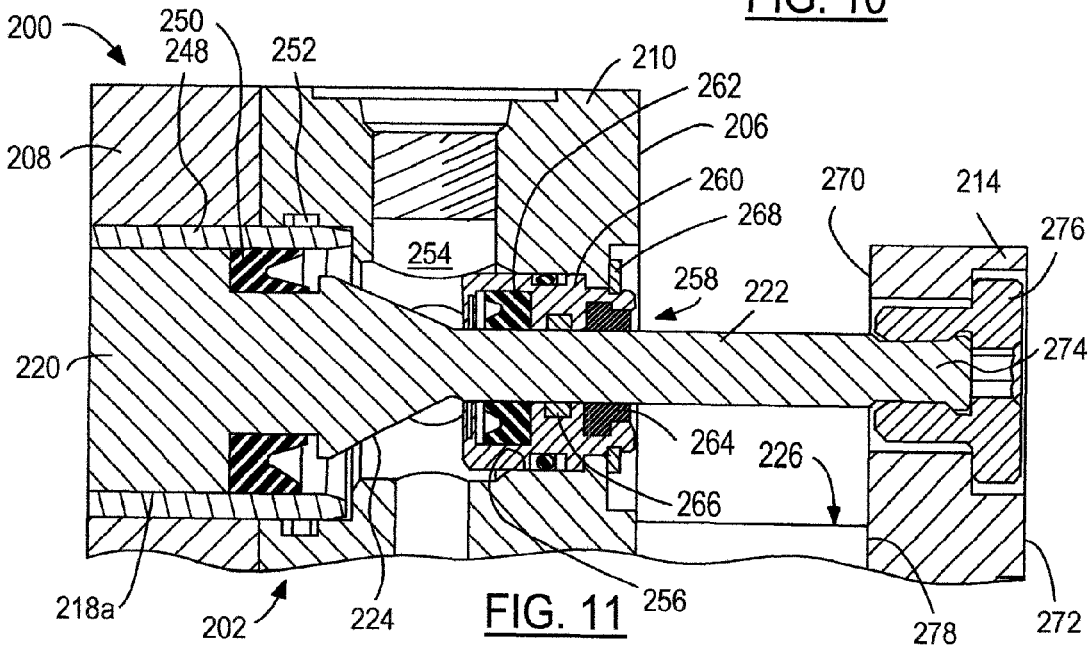
FIG. 11 illustrates an enlarged portion of the cross-sectional view of the tool actuator of FIG. 10.

Referring now to FIG. 11, the manifold bearing block 210 carries the guide rod portions 222 of the pistons 218*a*, 218*b*. The manifold bearing block 210 may be fastened to the piston block 208 in any suitable manner, such as using cap screws 251 (FIG. 1) or the like. The manifold bearing block 210 may include a counterbore at a front end for carrying a rear portion of the sealing tube 248, and one or more sealing devices 252 for sealing between the block 210 and the sealing tube 248. The block 210 may also include an actuation chamber 254 adapted for fluid communication with the hydraulic power device 100 for communicating pressurized fluid to the reaction surfaces 224 of the pistons 218*a*, 218*b*. The block 210 may further include a stepped bore 256 in its rear end for carrying any suitable guide rod seal and guide assemblies 258 that seal and guide the guide rod portions 222 of the pistons 218*a*, 218*b*.

The seal and guide assemblies 258 include a unitary seal and guide housing 260 interposed between the guide rod portions 222 and the block 210. The seal and guide housing 260 can include a forward counterbore for housing any suitable rod seal 262, such as a skirt seal or the like, and a rearward counterbore for housing a dust seal or wiper 264. The seal and guide housing 260 can also include a circumferentially continuous groove for carrying any suitable bearing member 266, such as a bushing, or the like to facilitate smooth translation of the guide rod 222 of the guide piston 218*a*, 218*b*. The seal and guide assemblies 258 can be carried by the manifold bearing block 210 using any suitable retainer 268, such as a snap ring or the like.

Still referring to FIG. 11, the return plate 214 cooperates with the pistons 218*a*, 218*b* and the gas springs 226*a*, 226*b* (FIG. 12) for retraction of the actuation plate 212. The return plate 214 includes a forward surface 270 and a rearward surface 272 with passages and counterbores therebetween. The pistons 218*a*, 218*b* may be connected to the return plate 214 in any suitable manner, such as where rearward ends 274 of the guide rods 222 of the pistons 218*a*, 218*b* are fastened to the return plate 214 by retainers 276 inserted into the passages and counterbores. The retainers 276 may be smaller in outer diameter or profile compared to the passages and counterbores to provide one example of a floating connection between the pistons 218*a*, 218*b* and the return plate 214 to minimize or eliminate binding of the assembly.

Referring now to FIG. 12, free ends 278 of the gas springs 226*a*, 226*b* engage the forward surface 270 of the return plate 214 to impose a rearward bias force thereon for retraction of the pistons 218*a*, 218*b* and actuation plate 212. The gas springs 226*a*, 226*b* can be any suitable type of gas springs and preferably extend through corresponding passages of the manifold bearing block 210 and include forward ends 280 disposed in corresponding counterbores in a rear end of the piston block 208. Preferably, the gas springs 226*a*, 226*b* collectively deliver a return force on the order of about ten percent or more of the maximum actuation force delivered by the tool actuator 200, to assist in removing tooling after a workpiece has been processed in a press operation.

Referring in general to all of the drawing figures, exemplary operation of the system 20 is described hereafter. In general operation, the press ram advances to move the piston rod 132 from a retracted position to an advanced position to decrease the volume of the pressure chamber 112 and thereby displace the hydraulic fluid therein through the high pressure passages 188 in the body 106 and, ultimately, to the actuation chamber 254 of the tooling actuator 200. There, the pressurized hydraulic fluid displaces the pistons 218*a*, 218*b* to axially advance the actuation plate 212 and tooling T. As the pistons 218*a*, 218*b* are advanced, the actuation plate 212 is moved away from the housing 202 and the return plate 214 is moved toward the housing 202 and, thus, displaces plungers of the gas springs 226, thereby increasing the pressure of the gas in the gas springs 226*a*, 226*b* and, hence, the biasing force the gas springs 226*a*, 226*b* exert on the return plate 214.

Subsequently, the press ram is retracted to allow the piston rod 132 to retract under backpressure, thereby relieving pressure in the pressure chamber 112, body 106, and actuation chamber 254. This reduction in pressure eventually allows the gas springs 226*a*, 226*b* to displace the return plate 214 away from the housing 202 to retract the pistons 218*a*, 218*b*. Retraction of the pistons 218*a*, 218*b* displaces the actuation plate 212 back toward the housing 202 to retract the tooling T and also decreases the volume of the actuation chamber 254 to return hydraulic fluid from the tool actuator 200 to the hydraulic power device 100. Therefore, the tool actuator 200 is reset to its retracted position so that the system 20 is ready for a subsequent cycle.

The system 20 may operate in at least two modes. A first mode may include punching or cutting operations, which normally do not involve a fixed stop such that a maximum tooling force is realized at an intermediate position along the stroke of the pistons 218*a*, 218*b*. For example, a maximum tooling force may be realized when a punch pierces a portion of the workpiece about midway through the stroke of the pistons 218*a*, 218*b*. A second mode may include forming, bending, or drawing types of operations where the maximum tooling force may be realized when the tooling T reaches a fixed stop before the end of the stroke of the pistons 218*a*, 218*b*. For example, a maximum tooling force may be realized when a forming tool pushes a portion of the workpiece into a fixed die, form, or stop.

In each mode, hydraulic overpressure conditions may occur if the pistons 218*a*, 218*b* encounter significant resistance when advancing under fluid pressure. For example, in the second mode, fluid pressure will suddenly increase when the tooling bottoms out against the workpiece and die at the fixed stop. Similarly, in the first mode, fluid pressure will suddenly increase if the relationship of the press ram and piston rod 132 are set to fully stroke the piston rod 132 to fully stroke the pistons 218*a*, 218*b*. Also in the first mode, fluid pressure will suddenly increase when the tooling T hits an obstruction such as where when the tooling T becomes misaligned or because multiple workpieces were inadvertently loaded to the die. To protect the system 20 under such overpressure conditions, the hydraulic pressure is relieved by the hydraulic power device 100.

The hydraulic power device 100 relieves hydraulic pressure in the system 20 using the pressure relief valve 192. When the press ram strokes the piston rod 132 to pressurize the hydraulic fluid in the system 20, the pressure relief valve 192 may be configured to open at a preset hydraulic pressure, such as during the aforementioned overpressure conditions. When the pressure relief valve 192 opens, hydraulic fluid flows from the high pressure passages 188, through the relief valve 192, into the low pressure passages 190, and into the accumulation chamber 164 of the accumulator 104. The flow of hydraulic fluid displaces the accumulator piston 160 against the pressure in the gas chamber 174, thereby increasing the pressure therein. The pressure in the gas chamber 174 may be relieved by the pressure fitting 186 above a certain pressure. When the press ram retracts and system hydraulic pressure is relieved, the pressurized gas in the gas chamber 174 displaces the piston 160 back toward a rest position. In turn, this piston movement displaces some of the hydraulic fluid from the accumulation chamber 164, through the low pressure passages 190 and check valve 194, and into the high pressure passages 188 for use in refilling the pressure chamber 112 for a subsequent cycle. The check valve 194 may maintain the hydraulic pressure in the accumulation chamber 164 at about the same pressure as the pressure in the gas chamber 174.

During typical first mode types of operations, the accumulator 104 may not cycle because overpressure conditions may not occur during a normal punching and cutting stroke. Nonetheless, if the relief valve setting is not sufficiently high, the accumulator 104 will cycle anyway. Accordingly, those skilled in the art will recognize that the settings of the relief valves 192, 194 are determined on a case-by-case basis depending on the size of the system components, the required tooling forces of each application, and the like. During typical second mode types of operations, however, the accumulator 104 will cycle to permit the tooling T to bottom out against the workpiece and form stop, or at full stroke of the pistons 218*a*, 218*b*. In this case, the press ram and pump rod strokes are configured to provide sufficient hydraulic pressure to stroke the pistons 218*a*, 218*b* slightly beyond that which is required to bottom out the tooling T.

FIGS. 15 through 22 illustrate another presently preferred form a tool actuator 300. This form is similar in many respects to the tool actuator 200 of FIGS. 1 and 7 through 14 and like numerals between the forms generally designate like or corresponding elements throughout the several views of the drawing figures. Accordingly, the descriptions of the tool actuators 200, 300 are incorporated by reference in their entireties into one another. Additionally, the description of the common subject matter generally may not be repeated here.

Figure 15:
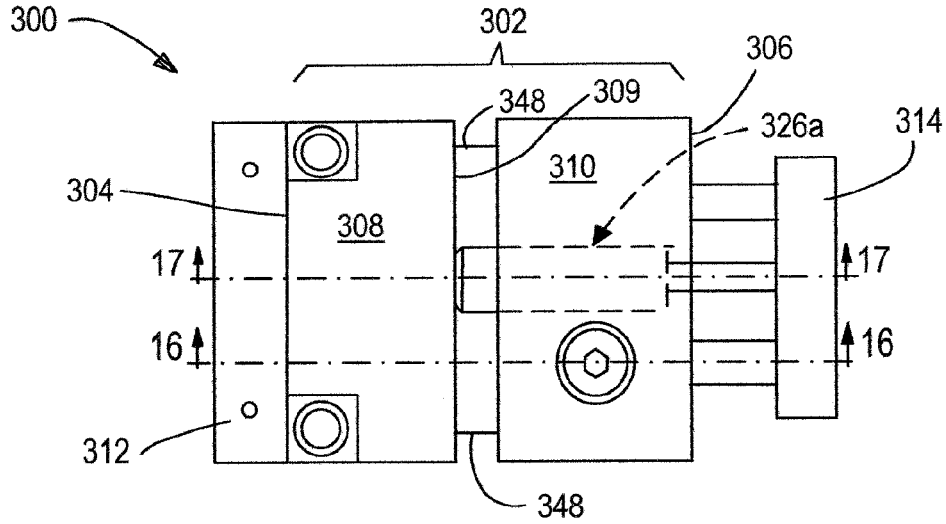
FIG. 15 is a top view of another presently preferred form of a tool actuator, shown in a fully retracted position.
Figure 16:
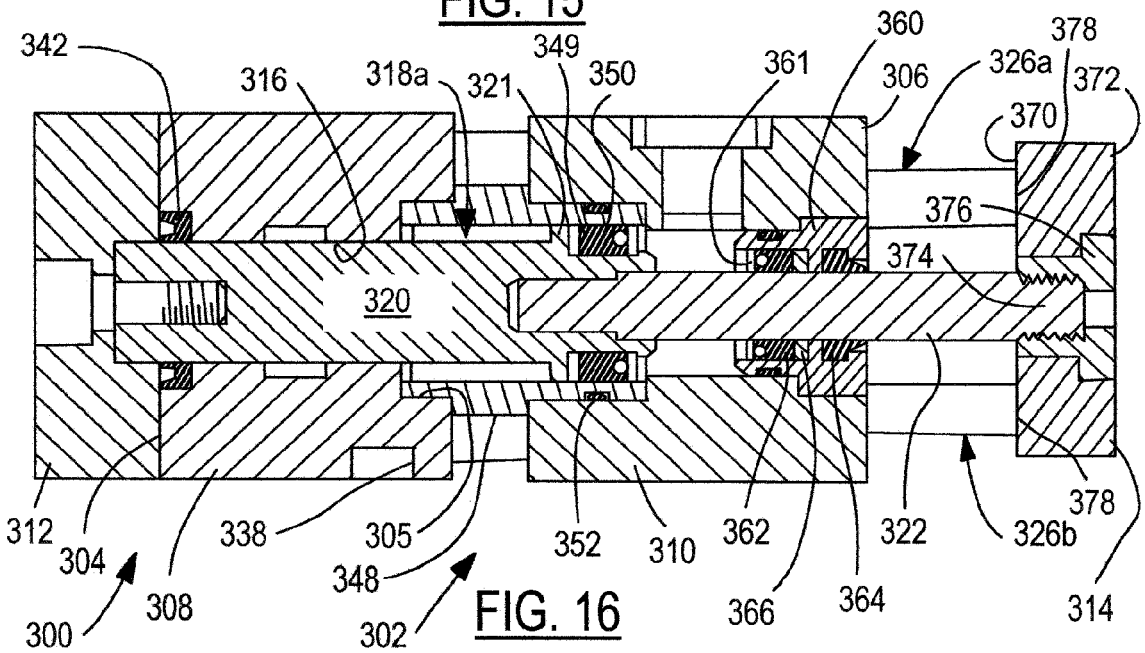
FIG. 16 is a cross-sectional view of the tool actuator of FIG. 15, taken along line 16-16.

Referring now in general to FIGS. 15 and 16, the tool actuator 300 may include a housing 302, which may include a front end 304 and a rear end 306 and may be defined by a piston block 308 and a manifold bearing block 310, and piston sealing tubes 348 positioned therebetween. The tool actuator 300 may also include an actuation plate 312 disposed at the front end 304 of the housing 302, and a return plate 314 disposed at the rear end 306 of the housing 302.

Figure 19:
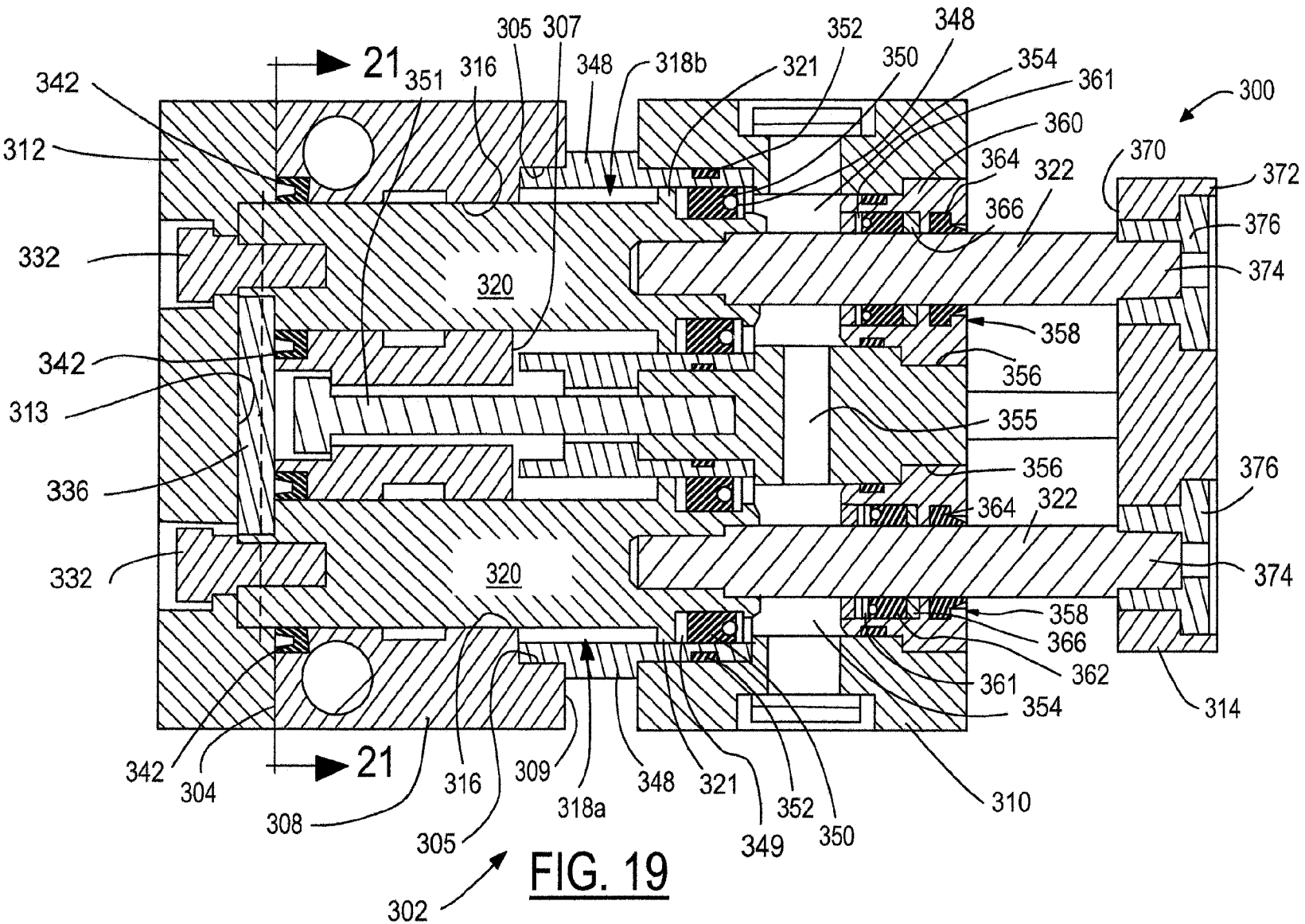
FIG. 19 is a cross-sectional view of the tool actuator shown in FIG. 18, taken along line 19-19.

As best shown in FIGS. 16 and 19, the tool actuator 300 may further include a pair of cylinders 316 extending longitudinally through the housing 302, and a pair of pistons 318*a*, 318*b* (one shown in FIG. 16) disposed in the pair of cylinders 316 and connected to the actuation and return plates 312, 314 for use in advancing and retracting the actuation plate 312. The pistons 318*a*, 318*b* may be two-piece assemblies including rearward guide rod portions 322 threaded into coaxially disposed forward piston portions 320. The piston portions 320 may include shoulders 321 that are configured to contact corresponding portions of the piston block 308 when fully stroked. Accordingly, the shoulders 321, instead of the return plate 314, may act to limit the stroke of the tool actuator 300. The pistons 318, 318*b* may be sealed to the piston sealing tubes 348 by seals 350, which may be carried on the forward piston portions 320 using backup rings 349 or the like. The seals 350 and rear surfaces of the forward piston portions 320 may define reaction surfaces, against which hydraulic fluid acts to displace the pistons 318*a*, 318*b*.

Figure 20:
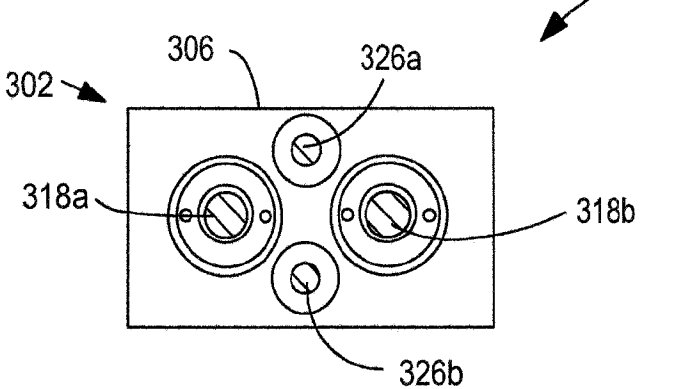
FIG. 20 is a cross-sectional view of the tool actuator shown in FIG. 18, taken along line 20-20.
Figure 18:
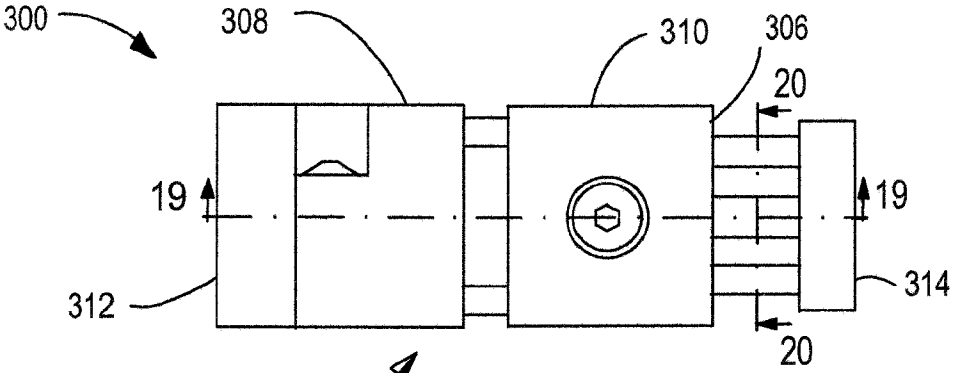
FIG. 18 is a side view of the tool actuator of FIG. 15.

Referring to FIGS. 15 and 20, the tool actuator 300 further includes one or more return devices, such as springs and, more particularly, gas springs 326*a* (one shown in FIG. 15), 326*b*. The gas springs 326*a*, 326*b* are carried by the housing 302 laterally inboard of the pistons 318*a*, 318*b* (FIG. 20) and are operatively biased against the return plate 314 (FIG. 15) to retract the actuation plate 312 (FIG. 15) via the pistons 318*a*, 318*b*. Forward ends of the gas springs 326*a*, 326*b* may be located against a rear surface 309 (FIG. 15) of the piston block 308, instead of within counterbores thereof.

Figure 21:
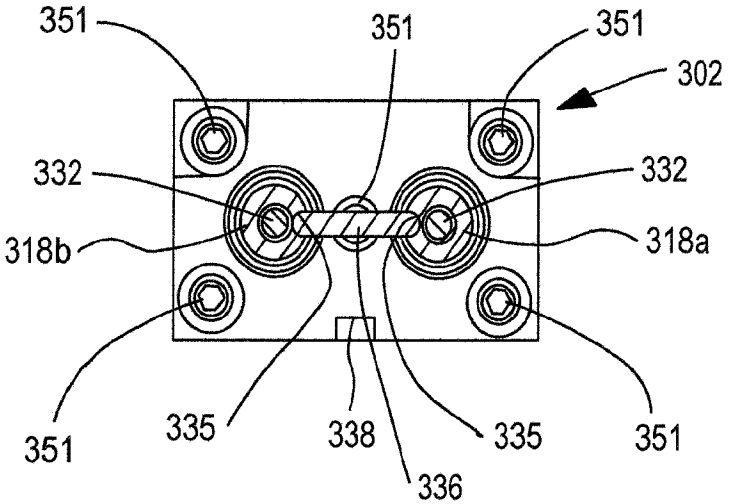
FIG. 21 is a cross-sectional view of the tool actuator shown in FIG. 19, taken along line 21-21.
Figure 23:
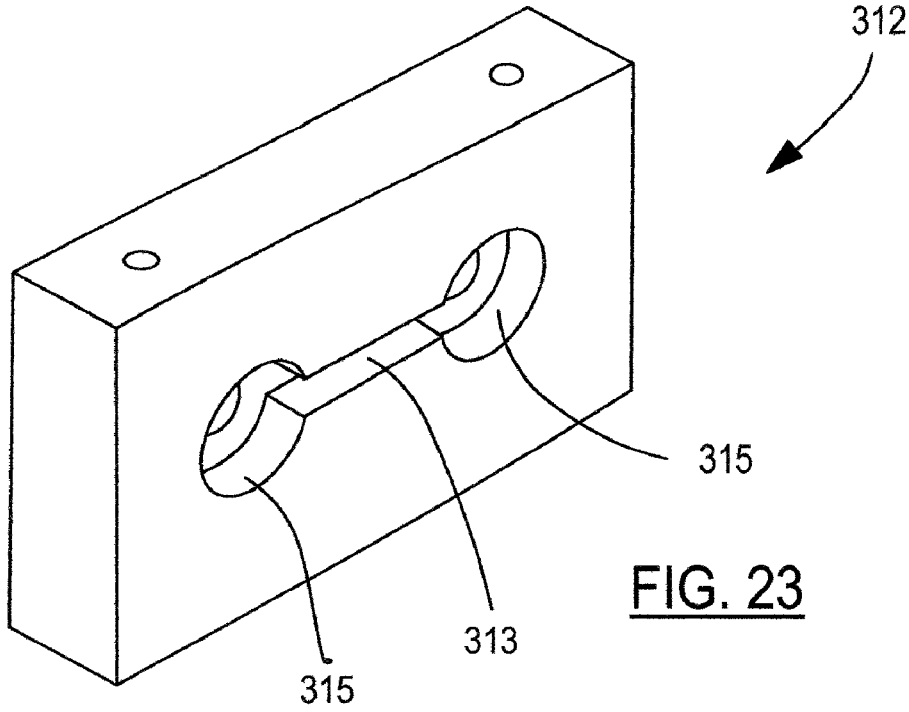
FIG. 23 is a perspective view of an actuation plate of the tool actuator of FIG. 15.

Referring now to FIGS. 19 and 21, the actuation plate 312 (FIG. 19) is connected to the pistons 318*a*, 318*b* in any suitable manner, such as by separate fasteners like cap screws 332 threaded into forward ends of the pistons 318*a*, 318*b*. Also, the forward ends of the pistons 318*a*, 318*b* are preferably keyed to the actuation plate 312 with a key 336 to prevent rotation of the pistons 318*a*, 318*b*. The key 336 may be disposed in a keyway 313 (FIGS. 17 and 19) of the actuation plate 312 and its ends may be disposed in corresponding cutouts 335 (FIG. 21) in the forward ends of the pistons 318*a*, 318*b*. Accordingly, any thrust and torque reaction forces from the tooling are transmitted to the pistons 318*a*, 318*b*. FIG. 23 illustrates the actuation plate 312 having the keyway 313 between counterbores 315.

Referring to FIGS. 16 and 19, the piston block 308 of the housing 302 may carry part of the forward piston portions 320 of the pistons 318*a*, 318*b*. The piston block 308 may include counterbores in its forward end for carrying any suitable wipers or seals 342. The piston block 308 may also include counterbores 305 in its rearward end 309 for carrying the sealing tubes 348 therein for carrying and sealing parts of the guide pistons 318*a*, 318*b* via piston seals 350, which may be skirt seals or U-cup seals or the like.

Figure 24:
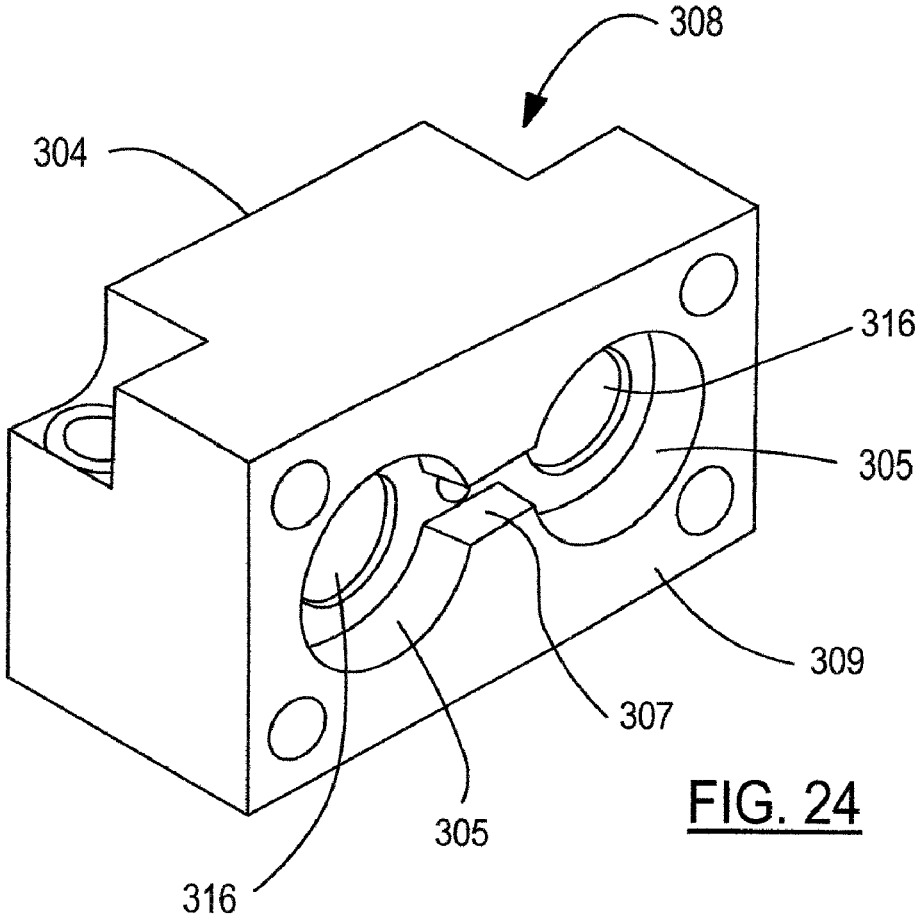
FIG. 24 is a perspective view of a piston block of the tool actuator of FIG. 15.

As best shown in FIGS. 19 and 24, the rearward surface 309 of the piston block 308 may also include a vent 307 between the counterbores 305. The vent 307 allows fluid communication between the sealing tubes 348 and an open axial space between the piston and bearing blocks 308, 310. Accordingly, when the tool actuator 300 is pressurized with hydraulic fluid, air in the sealing tubes 348 can be vented via the vent 307 to allow the pistons 318*a*, 318*b* to stroke.

Referring to FIG. 19, the sealing tubes 348 may be modular components of the housing 308. The sealing tubes 348 may provide sealing inner diameters for the pistons and may include outer shoulders or larger outer diameter portions adapted to set spacing between the piston block 308 and manifold bearing block 310 by interfacing with rearward and forward surfaces, respectively, thereof. The opposite ends of the sealing tubes 348 may also or instead be used to set the spacing between the piston block 308 and bearing block 310. In any case, the piston block 308 and the manifold bearing block 310 may be common components that are shared among multiple tool actuator applications, whereas the sealing tube 348 may be customized or modular in size depending on a particular application. For example, an application involving a longer piston stroke length can use relatively longer sealing tubes compared to an application involving shorter piston stroke length, yet both such applications can use the same piston block and bearing block. Accordingly, the tool actuator 300 may be of modular design.

The manifold bearing block 310 carries the guide rod portions 322 of the pistons 318*a*, 318*b*, and may be fastened to the piston block 308 in any suitable manner, such as using fasteners 351 or the like. As shown in FIG. 21, five fasteners 351 may be used, for example, one at each corner and one centrally disposed. Referring to FIG. 19, the manifold bearing block 310 may include counterbores at a front end for carrying rear portions of the sealing tubes 348, and seals 352 for sealing between the block 310 and the sealing tubes 348. The block 310 may also include actuation chambers 354 adapted for fluid communication with the hydraulic power device 100 for communicating pressurized fluid to the reaction surfaces of the pistons 318*a*, 318*b*. The block 310 may further include a transfer passage 355 between the actuation chambers 354 for fluid communication therebetween. The block 310 may further include counterbored passages 356 for carrying any suitable guide rod seal and guide assemblies 358 that seal and guide the guide rod portions 322 of the pistons 318*a*, 318*b*.

The seal and guide assemblies 358 may include unitary seal and guide housings 360 interposed between the guide rod portions 322 and the block 310. The seal and guide housings 360 may include forward counterbores for housing any suitable rod seals 362, such as skirt seals or the like, and rearward counterbores for housing dust seals or wipers 364. The assemblies 358 may also include retainer rings 361 to retain the rod seal 362. The seal and guide housings 360 can also include any suitable bearing members 366, such as bushings, or the like to facilitate smooth translation of the guide rods 322 of the guide pistons 318*a*, 318*b*. The seal and guide assemblies 358 can be carried by the manifold bearing block 310 in any manner, for example, the housings 360 may be threaded to the bearing block 310.

Referring to FIGS. 16 and 19, the return plate 314 cooperates with the pistons 318*a*, 318*b* and the gas springs 326*a*, 326*b* for retraction of the actuation plate 312. The return plate 314 includes a forward surface 370 and a rearward surface 372 with passages and counterbores therebetween. The pistons 318*a*, 318*b* may be connected to the return plate 314 in any suitable manner, such as where rearward ends 374 of the guide rods 322 of the pistons 318*a*, 318*b* are fastened to the return plate 314 by retainers 376 inserted into the passages and counterbores. The retainers 376 may be smaller in outer diameter or profile compared to the passages and counterbores to provide one example of a floating connection between the pistons 318*a*, 318*b* and the return plate 314 to minimize or eliminate binding of the assembly.

Figure 17:
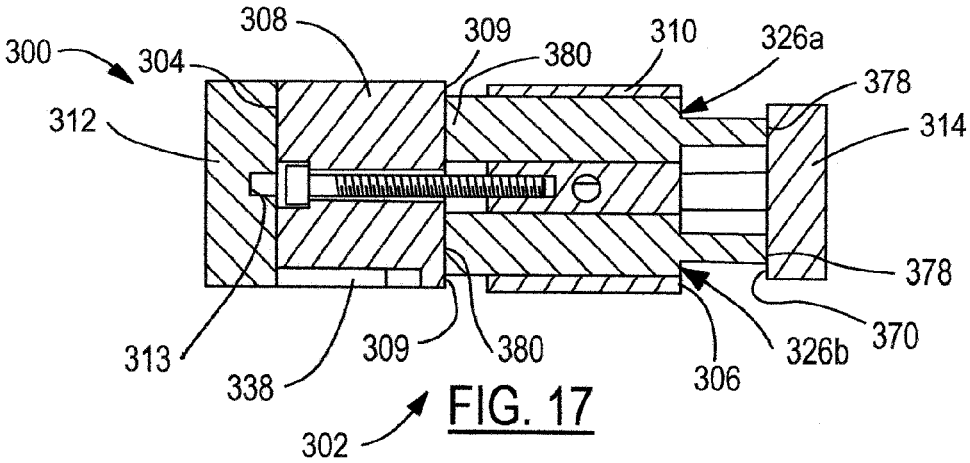
FIG. 17 is a cross-sectional view of the tool actuator of FIG. 15, taken along line 17-17.

Referring now to FIG. 17, free ends 378 of the gas springs 326*a*, 326*b* engage the forward surface 370 of the return plate 314 to impose a rearward bias force thereon for retraction of the pistons 318*a*, 318*b* and actuation plate 312. The gas springs 326*a*, 326*b* can be any suitable type of gas springs and preferably extend through corresponding passages of the manifold bearing block 310 and include forward ends 380 disposed against the rear surface 309 of the piston block 308.

Figure 22:
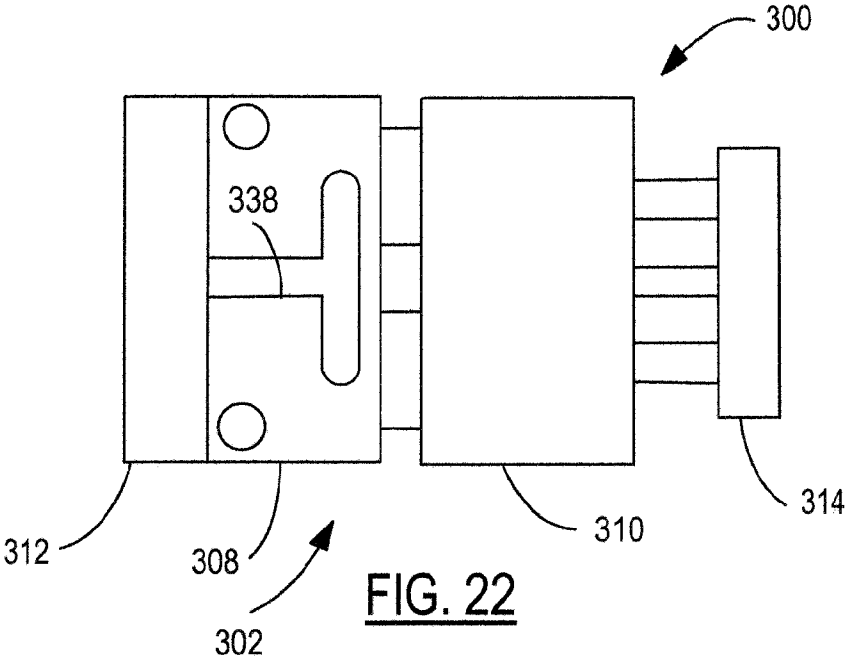
FIG. 22 is a bottom view of the tool actuator of FIG. 15.

As shown in FIGS. 21 and 22, the piston block 308 may be located and fastened to any suitable press component using a suitable keyway 338 and fasteners (not shown) carried by the piston block 308. The keyway 338 may be T-shaped as shown in FIG. 22.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A press-driven hydraulic power device for hydraulically powering a tool actuator, including:

a pump including a pump piston disposed in a pump cylinder for pressurizing hydraulic fluid therein;

an accumulator in fluid communication with the pump cylinder, and including an accumulator piston disposed in an accumulator cylinder that houses hydraulic fluid on one side of the accumulator piston; and a body supporting the hydraulic pump and hydraulic accumulator thereon and being in fluid communication between the pump and accumulator cylinders, and including a pressure relief valve downstream of the pump cylinder and upstream of the accumulator cylinder, and further including a check valve downstream of the accumulator cylinder and upstream of the pump cylinder, and further comprising a plunger assembly including a bearing and seal assembly carried in an open end of the pump cylinder, and a rod carried in the bearing and seal assembly and adapted to be actuated by a press ram to displace the pump piston.

2. The device of claim 1, wherein the bearing and seal assembly includes a bearing and seal housing, which carries a rod wiper, a bearing, and a seal at an inner diameter thereof, the bearing and seal housing being retained within the pump cylinder by a wire retention ring and being sealed thereto with at least one seal.

3. The device of claim 1, wherein the rod is attached at a forward end thereof to the pump piston with a wire retention ring.

4. The device of claim 1, wherein the rod includes an air bleed passage extending therethrough, and an air bleed valve is preferably sealingly threaded into the air bleed passage.

5. The device of claim 1, wherein the accumulator cylinder is composed of at least one of a translucent or transparent material to enable visual verification of fluid level in the accumulator cylinder.

6. The device of claim 1, wherein the accumulator also includes a cover at least partially defining a gas chamber on the other side of the accumulator piston and including a gas exhaust passage, which is in communication with the gas chamber and includes a pressure fitting therein for exhausting gas from the gas chamber.

7. The device of claim 1, wherein the accumulator cylinder houses a gas in a gas chamber on another side of the accumulator piston; and the pump and accumulator cylinders are mounted side-by-side to a top surface of the body.

8. The device of claim 7, wherein the body includes high pressure hydraulic passages in communication with the pump and low pressure hydraulic passages in communication with the accumulator, the pressure relief valve is a hydraulic pressure relief valve provided between the high and low pressure hydraulic passages in the body, and the check valve is a hydraulic check valve provided between the high and low pressure hydraulic passages.

9. The device of claim 7, wherein the pressure relief valve opens at a preset hydraulic pressure to relieve hydraulic pressure in the pump cylinder by allowing hydraulic fluid to flow from the pump cylinder into the accumulator cylinder to displace the accumulator piston against pressure in the gas chamber of the accumulator.

10. The device of claim 9, wherein the pump piston is retractable upon retraction of the press ram wherein the gas in the gas chamber of the accumulator displaces the accumulator piston back toward a rest position to displace some hydraulic fluid from within the accumulator cylinder through the check valve and back to the pump cylinder.

11. The device of claim 1, wherein the pump and accumulator are supported side-by-side on the body and the pump and accumulator cylinders are mounted to a top surface of the body.

12. The device of claim 1, wherein the accumulator cylinder also defines a gas chamber on the other side of the accumulator piston, the pump piston is strokeable by movement of a press ram to pressurize hydraulic fluid in the pump cylinder wherein the pressure relief valve opens at a preset hydraulic pressure to relieve hydraulic pressure in the pump cylinder by allowing hydraulic fluid to flow from the pump cylinder into the accumulator cylinder to displace the accumulator piston against pressure in the gas chamber of the accumulator.

13. The device of claim 12, wherein the pump piston is retractable upon retraction of the press ram wherein the gas in the gas chamber of the accumulator displaces the accumulator piston back toward a rest position to displace some hydraulic fluid from within the accumulator cylinder through the check valve and back to the pump cylinder.

14. A press-driven hydraulic power device, comprising:

a pump including a pump piston, a pump cylinder that houses hydraulic fluid in a pressure chamber on one side of the pump piston, a bearing and seal assembly carried in an open end of the pump cylinder, and a piston rod received in the bearing and seal assembly and extending from the open end of the pump cylinder to be actuated by a press ram to displace the pump piston in the pump cylinder;

an accumulator in downstream fluid communication with the pressure chamber of the pump, and including an accumulator piston disposed in an accumulator cylinder that houses hydraulic fluid in an accumulation chamber on one side of the accumulator piston and houses a gas in a gas chamber on another side of the accumulator piston;

a body supporting the hydraulic pump and hydraulic accumulator thereon and being in fluid communication between the pump and accumulator cylinders, and including a pressure relief valve downstream of the pump cylinder and upstream of the accumulator cylinder, and further including a check valve downstream of the accumulator cylinder and upstream of the pump cylinder; and the pump piston being strokeable by movement of a press ram to pressurize hydraulic fluid in the pressure chamber wherein the pressure relief valve opens at a preset hydraulic pressure to relieve hydraulic pressure in the pressure chamber of the pump by allowing hydraulic fluid to flow from the pressure chamber of the pump into the accumulation chamber of the accumulator to displace the accumulator piston against pressure in the gas chamber of the accumulator.

15. The press-driven hydraulic power device of claim 14, wherein the pump piston is retractable upon retraction of the press ram wherein the gas in the gas chamber of the accumulator displaces the accumulator piston back toward a rest position to displace some hydraulic fluid from within the accumulation chamber through the check valve and back to the pump chamber.

16. The press-driven hydraulic power device of claim 14, wherein the body includes high pressure hydraulic passages in communication with the pump and low pressure hydraulic passages in communication with the accumulator, and the pressure relief valve is a hydraulic pressure relief valve provided between high and low pressure hydraulic passages in the body and in a location downstream of the pump cylinder and upstream of the accumulator cylinder, and the check valve is a hydraulic check valve provided between the high and low pressure hydraulic passages and in a location downstream of the accumulator cylinder and upstream of the pump cylinder.

* * * * *